US008833100B2

(12) United States Patent
Meyerholtz et al.

(10) Patent No.: US 8,833,100 B2
(45) Date of Patent: Sep. 16, 2014

(54) WATER RESERVOIR PRESSURE VESSEL

(75) Inventors: Eric R. Meyerholtz, Evansville, IN (US); Manoj K. Shrestha, Newburgh, IN (US); Jeffrey J. Smale, Evansville, IN (US); Larry A. Lutz, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 980 days.

(21) Appl. No.: 11/946,636

(22) Filed: Nov. 28, 2007

(65) Prior Publication Data

US 2008/0156015 A1 Jul. 3, 2008

Related U.S. Application Data

(60) Provisional application No. 60/882,277, filed on Dec. 28, 2006.

(51) Int. Cl.
*F25D 3/02* (2006.01)
*F25D 23/12* (2006.01)

(52) U.S. Cl.
CPC ..... *F25D 23/126* (2013.01); *F25D 2323/122* (2013.01); *F25D 2323/121* (2013.01)
USPC ..... 62/318; 62/338

(58) Field of Classification Search
CPC ..... F25B 43/003; F25D 2323/121; F25D 2323/122
USPC ..... 222/146.1, 146.6; 62/318, 347, 62/389–391, 317, 337–339; 210/261, 210/257.5; 220/22.83, 23.86, 23.88
See application file for complete search history.

(56) References Cited

U.S. PATENT DOCUMENTS

| | | | | |
|---|---|---|---|---|
| 2,982,114 | A | 5/1961 | Cobb et al. | |
| 3,908,394 | A | 9/1975 | Jacobus | |
| 3,982,406 | A * | 9/1976 | Hanson et al. | 62/339 |
| 4,036,620 | A * | 7/1977 | Benasutti et al. | 62/338 |
| 5,083,442 | A * | 1/1992 | Vlock | 62/338 |
| 5,428,079 | A * | 6/1995 | Bastiaansen et al. | 522/161 |
| 5,707,518 | A | 1/1998 | Coates et al. | |
| 6,101,835 | A * | 8/2000 | Butsch et al. | 62/390 |

(Continued)

FOREIGN PATENT DOCUMENTS

| | | |
|---|---|---|
| WO | 9745914 A1 | 12/1997 |
| WO | 03099732 A1 | 12/2003 |

OTHER PUBLICATIONS

European Patent Application No. 07255034.6, filed Jul. 2, 2008, Applicant: Whirlpool Corporation; European Search Report, mail date: Nov. 21, 2013 re: same.

*Primary Examiner* — Cassey D Bauer

(57) ABSTRACT

Refrigeration devices that have a water dispensing system to dispense water to an exterior water dispenser from a water supply line have need of a water vessel for storing water under pressure within the refrigeration device until dispensed. The water vessel has an inlet for receiving water from the water supply line and an outlet for dispensing water to the exterior water dispenser. A plurality of pressure resistant walls are formed between the inlet and the outlet to form an internal volume to reservoir water within the water vessel. The water vessel is constructed to reservoir water within the vessel under hydrostatic pressure from the water supply line until dispensed through the outlet when requested by the exterior water dispenser and/or the icemaker.

23 Claims, 5 Drawing Sheets

(56) References Cited

U.S. PATENT DOCUMENTS

| | | | | |
|---|---|---|---|---|
| 6,532,758 | B2 | 3/2003 | DuHack | |
| 6,622,509 | B2 | 9/2003 | Stich et al. | |
| 6,681,585 | B1 | 1/2004 | Stagg et al. | |
| 7,067,054 | B2 * | 6/2006 | Fritze | 210/85 |
| 7,287,397 | B2 * | 10/2007 | Coulter et al. | 62/338 |
| 2002/0189275 | A1 * | 12/2002 | DuHack | 62/389 |
| 2003/0190272 | A1 * | 10/2003 | Raine et al. | 422/300 |
| 2004/0211790 | A1 * | 10/2004 | Werth | 222/212 |
| 2004/0251210 | A1 | 12/2004 | Fritze et al. | |
| 2005/0047846 | A1 * | 3/2005 | Narang et al. | 401/133 |
| 2006/0021745 | A1 | 2/2006 | Fritze | |
| 2006/0081805 | A1 | 4/2006 | Olson et al. | |
| 2006/0260345 | A1 | 11/2006 | Coulter et al. | |

* cited by examiner

WATER RESERVOIR PRESSURE VESSEL

CROSS-REFERENCE TO RELATED APPLICATIONS

This application claims priority under 35 U.S.C. §119 of a provisional application Ser. No. 60/882,277 filed Dec. 28, 2006, which application is hereby incorporated by reference in its entirety.

FIELD OF THE INVENTION

The present invention relates to the field of pressurized water storage vessels; and more particularly, to the field of pressurized water storage vessels for ergonomically and safely reservoiring and chilling water within a refrigeration device for subsequent use.

BACKGROUND OF THE INVENTION

Water reservoir vessels or water storage tanks for storing water under pressure are known in the art. Examples of some reservoirs are disclosed in U.S. Pat. Nos. 6,532,758 5,707, 518, 3,982,406, and 3,908,394. These water storage tanks have an inlet and an outlet and are generally in fluid communication with a valve or multiple valves, a water inlet and a filter. The tanks vary in shape and design in an attempt to maximize the volume of water they are able to store. A typical design may include the use of baffles, coils, loops and/or horizontally extending passages. A primary purpose of these tanks is to provide a reservoir where water can be stored in the refrigerator and kept at a cool temperature associated with the refrigerator, in preparation for subsequent use in an icemaker or dispersal through a water dispenser. To preserve the tank and prevent fatigue related failures, these tanks are typically operated under atmospheric conditions. This can cause unwanted dripping of water from the exterior dispenser. Similarly, dripping contributes to water waste and causes unsightly and unwanted water stains on and around the exterior dispenser. Additionally, water storage tanks operating at atmospheric pressure are typically disposed inline after the filtration member and valves because the filtration member requires a pressure above atmospheric pressure to operate properly. This permits filtered water, free of chlorine and other bacteria killing agents, to sit in the water tank, which may require the tank to be cleaned or flushed periodically to prevent bacterial growth within the tank.

An important aspect of water storage tanks is the amount of refrigerator space they occupy. Generally, considerations appurtenant to the water storage tank and keeping the filter cartridge accessible require the two to be positioned apart within the refrigerator. Inherently, such an approach necessarily requires the individual components to be piecemealed together thereby increasing the amount and length of water lines within the refrigerator. Invariably, the farther the tank is positioned away from the filter and points of disbursement (i.e., the icemaker and water dispenser), the longer water lines tubes and amount of line increases. Moreover, positioning the tank and filter apart may require two separate housings thereby occupying additional refrigerator space. Some considerations have been given to water storage tanks for storing water within the refrigerator while under pressure from the water supply line. U.S. Pat. App. No. 2004/0251210 uses a water storage means in fluid communication with the filter. However, little consideration is given to the failure criteria critical to the design of a tank for storing water under pressure and preserving the operational life cycle of the tank over the life the refrigerator.

While these tanks may have been useful for their intended purpose, there is a desire to provide a more compact pressurized water storage vessel having a high thermal stability, resistance to slow crack propagation and an overall resistance against fatigue related failures. Additionally, there is a desire to maximize the operational life of the vessel without losing the benefits and features desirable in water storage vessels within the refrigeration device, such as increased water retention volumes, decreased space requirements, placement flexibility, improved aesthetics and water quality, and simplified installation and integration into pre-existing and new designs/models.

BRIEF SUMMARY OF THE INVENTION

Therefore it is a primary object, feature, or advantage of the present invention to improve over the state of the art.

It is a further object, feature, or advantage of the present invention to provide a water reservoir pressure vessel wherein the vessel is constructed of a cross-linked, high-density polyethylene (HDPE) wherein the cross-inking is by beta irradiation.

Yet another object, feature, or advantage of the present invention is to provide a water reservoir pressure vessel for fitting behind the filter eject button of the filter disclosed in U.S. Pat. App. No. 2006/0081805.

A further object, feature, or advantage of the present invention is to provide a water reservoir pressure vessel resistant to fatigue related failures.

Yet another object, feature, or advantage of the present invention is to provide a water reservoir pressure vessel capable of being disposed in advance of the water filter and valves to keep chlorinated water in the vessel to prevent bacterial growth.

One or more of these and/or other objects, features, or advantages of the present invention will become apparent from the specification and claims that follow.

According to one aspect of the present invention, a water vessel for use with a refrigeration device having a water dispensing system to dispense water from a water supply line to an exterior water dispenser and/or an icemaker is disclosed. The water vessel is constructed having an inlet adapted to be in fluid communication with the water supply line and an outlet adapted to be in fluid communication with the exterior water dispenser. A plurality of pressure resistant walls are formed between the inlet and the outlet to create an internal volume to reservoir water. The water vessel is constructed to reservoir water within the water vessel under hydrostatic pressure from the water supply line until dispensed through the outlet when requested by the exterior water dispenser and/or icemaker. In the preferred form, the water vessel is constructed of a cross-linked, high-density polyethylene to withstand thermal expansion and contraction and hydrostatic pressure from the water supply line, and the water vessel is cross-linked by beta irradiation. A new method for dispensing water in a refrigeration device is also disclosed. The method includes providing a water vessel having a plurality of pressure resistant walls spaced between an inlet and an outlet to form an internal volume for reservoiring water therein, and the water vessel is disposed inline in advance of the water valve. Positioning the water vessel inline in advance of the water valve prevents water from dripping from the exterior water dispenser during thermal expansion and contraction of the water vessel Water is stored within the water vessel under hydrostatic pressure from the water supply line until requested at the exterior water dispenser. Water is then dispensed from the water vessel at the exterior water dispenser. In the preferred form, the method includes disposing the water vessel inline in advance of the water filter for filtering water from the water vessel before dispensing at the exterior water dispenser.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENTS

The present invention includes a number of aspects all of which have broad and far-reaching application. One aspect of the present invention relates to the use of a water reservoir pressure vessel in combination with a water filter of the type as disclosed in U.S. Application Publication No. 2006/0081805. Another aspect of the present invention relates to the use of a water reservoir pressure vessel being capable of operating for the life of the refrigeration device by being resistant to fatigue related failures. Another aspect of the present invention relates to the use of a water reservoir pressure vessel being positionable within a preexisting housing and/or the refrigeration device near the exterior dispenser and before the water filter and water solenoid valves to thereby improve the taste of the water being dispensed. Still another aspect of the present invention relates to the construction of a water reservoir pressure vessel from cross-linked, high-density polyethylene using beta irradiation. Although specific embodiments are described herein, the present invention is not to be limited to these specific embodiments. The present invention contemplates numerous other options in the design and use of the water reservoir pressure vessel.

Figure 1:
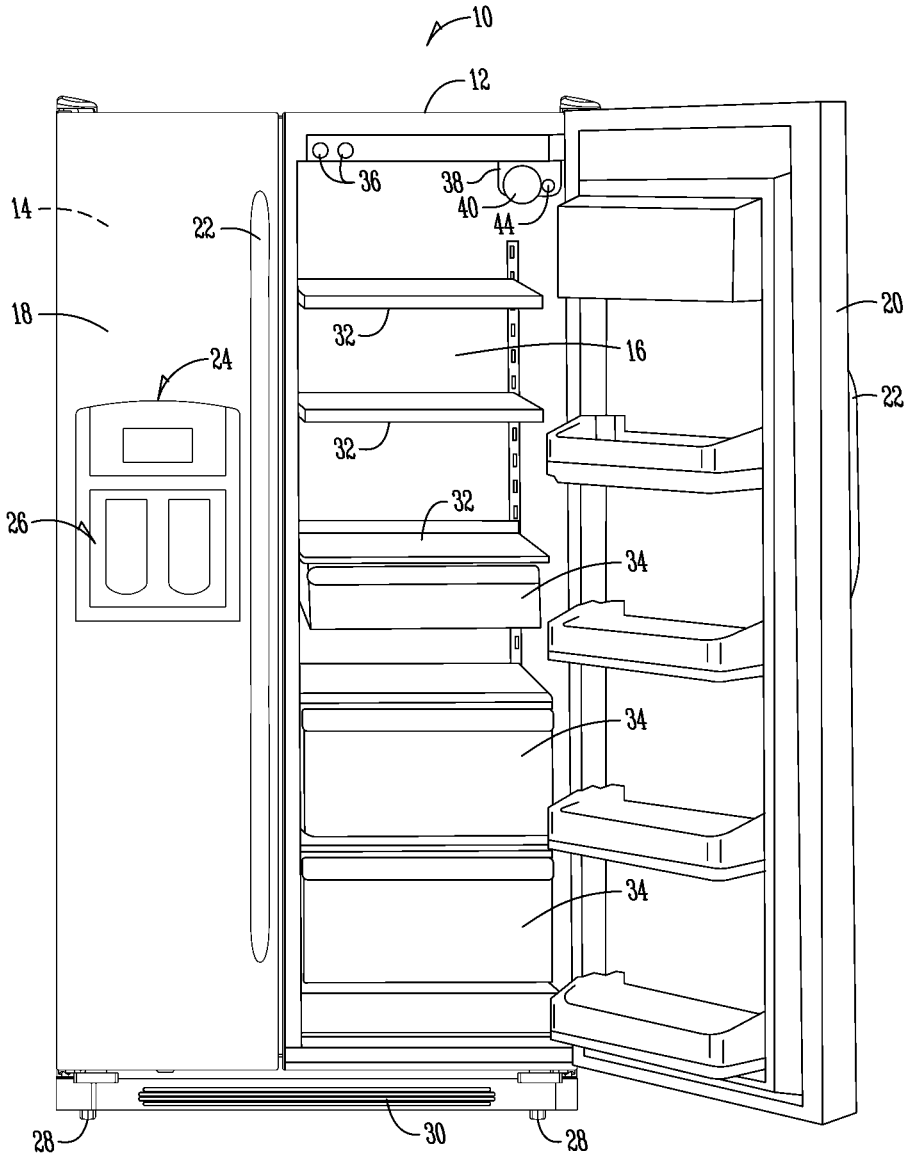
FIG. 1 is a diagrammatic illustration of a refrigeration device having a water reservoir pressure vessel according to one exemplary embodiment of the present invention.

FIG. 1 is diagrammatic illustration of a refrigeration device having a water reservoir pressure vessel according to one exemplary embodiment of the present invention. In FIG. 1, a refrigeration device 10 is shown. The refrigeration device 10 can be any household refrigerator that has an exterior dispenser 24 for dispensing water and/or ice. The refrigeration device 10 may be a pre-existing refrigerator, one currently being manufactured or one contemplative only in a design. Generally, the refrigeration device 10 has a top portion 12 and a bottom portion supported by rollers 28 as is customary with household refrigerators.

The refrigeration device 10 may be of the type having doors side by side, a freezer on top or a freezer on bottom. In the case of a side by side refrigerator, the refrigeration device 10 has a side left door 18 and a side right door 20. Handles 22 allow access to the freezer compartment 14 and the refrigerator compartment 16 by opening the side left door 18 and side right door 20, respectively. As a general feature, the interior of the freezer compartment 14 and the refrigerator compartment 16 are fitted with shelves 32 and drawers 34. Additionally, controls 36 allow temperature adjustment for the freezer 14 and refrigerator 16 compartments. A grill 30 positioned at or near the bottom of the refrigerator 10 permits the transfer of heat for extracting heat from the freezer compartment 14 and refrigerated compartment 16.

An exterior dispenser 24 may be positioned on the side left door 18 or the side right door 20 for dispensing ice and/or water therefrom. Typical exterior dispensers have a dispensing compartment 26, as shown in FIG. 1 for placing and/or holding a container for collecting ice and/or water being dispensed from the exterior dispenser 24.

Figure 2:
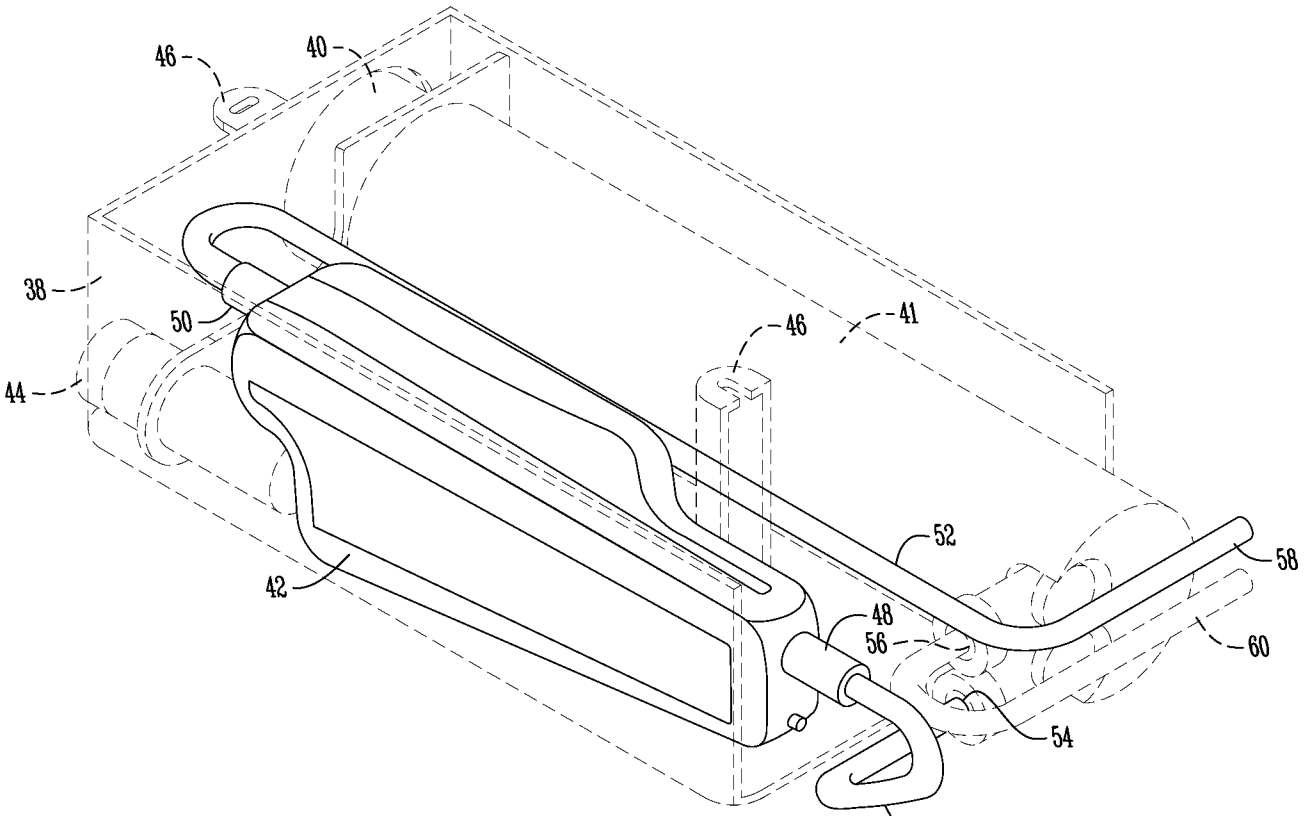
FIG. 2 is another diagrammatic illustration of a covering housing a water filter and water reservoir pressure vessel according to one exemplary embodiment of the present invention.

Covering 38 is shown at or near the top 12 of the refrigeration device 10 in covering relation to the filter 40 and water reservoir pressure vessel 42 (shown in FIG. 2). The filter 40 and water reservoir pressure vessel 42 are in fluid communication with the exterior dispenser 24 and/or icemaker (not shown). The covering 38 is a protective cover for preventing damage, dislodgment or failure of the filter 40 and vessel 42. The covering 38 also provides aesthetic appeal. The covering 38 housing the filter 40 and vessel 42 may be positioned anywhere within the refrigeration device 10. It should be appreciated that the neither the filter 40 and/or vessel 42 are restricted to a specific position within the refrigeration device 10. Furthermore, in the preferred embodiment, the covering 38 containing the filter 40 and/or vessel 42 could be positioned close to a dispensing point such as the exterior dispenser 24. Such placement of the filter 40 and the vessel 42 near a dispensing point would invariably limit the length and number of water lines needed to communicate water from the filter 40 and the vessel 42 to the exterior dispenser 24. It is not necessary that the covering 38 be a separate piece unto itself. It is well known in the art that any covering may act as a guard and a protective housing to the filter 40 and vessel 42. For example, the filter 40 and vessel 42 may be positioned behind compartment walls and/or sidewalls of the refrigeration device 10 so as to protect them from being dislodged or damaged. Moreover, in some instances, a protective covering such as disclosed herein may not be needed to house or protect the filter 40 and vessel 42 from damage or dislodgment. In either case, the filter 40 and vessel 42 may be positioned within protective covering 38 as shown herein and/or positioned behind compartment walls and/or sidewalls of the refrigerator device 10 as would be appreciated by those skilled in the art. It should also be further appreciated that the vessel 42 need not be positioned within the covering 38 having the filter 40 therein. The present invention contemplates that the vessel 42 could be positioned anywhere within the refrigeration device 10 as should be appreciated by one skilled in the art. However, in the instance where the covering 38 permits or has additional space for housing the vessel 42 it is preferred that vessel 42 be positioned within the covering 38. Such configuration maximizes the refrigerator space without requiring additional coverings positioned within the refrigeration device 10 or special configurations for placing vessel 42 and/or filter 40 behind compartment or sidewalls of the refrigerator device 10. The covering 38 may be attached to the refrigeration device 10 at any point or positioned within the refrigeration device 10 as stated before.

The means of attaching the covering 38 can be appreciated by those skilled in the art. For example, the covering 38 could be attached to a wall within the refrigeration device 10 using screws, rivets, and/or expansion pins. Moreover, the covering 38 could simply snap into position.

FIG. 2 is another diagrammatic illustration of a covering housing a water filter and water reservoir pressure vessel according to one exemplary embodiment of the present invention. The filter 40 could be any water filtering member. Preferably, the filter 40 is one in which the filter may be quickly released, replaced, exchanged, or inserted. The filter 40 may also be pre-assembled along with the vessel 42 within the covering 38 such that the filter 40, vessel 42 and covering 38 are a completed and pre-assembled component for installation within the refrigeration device 10. Additionally, the filter 40 is of the type that requires pressure from some source, generally the water supply line, to operate properly. A preferred water filter 40 is of the type disclosed in U.S. Application Publication No. 2006/0081805. The vessel 42 may be incorporated into the covering 38 behind the push button 44 in such a way as to ergonomically use the remaining space within the covering 38 between the covering 38 and the filter 40 without creating an additional covering or occupying space within the refrigerator 10. In this sense, other filters may be well suited for use with the vessel 42 wherein the vessel 42 may be placed optimally within the covering 38 having the filter 40 without occupying additional space within the refrigeration device 10.

It is recognized that the vessel 42 need not be positioned within the covering 38 but within the refrigeration device 10 where space permits. Moreover, because of the shape-ability and mold-ability of the vessel 42, the vessel 42 may positioned in locations within the refrigeration device 10 where water containers having baffles, coils, tubes and/or horizontally extending passages may not fit.

Also shown in FIG. 2 is an elongated filter housing 41 for housing the filter 40. The filter 40 is releasable from the elongated filter housing 41 by actuating filter release button 44. The elongated filter housing 41 is equipped with quick couple/receiver bypass valves for providing an inlet and outlet passageway into the filter 40. These inlet and outlet passageways are connected to the filter inlet 54 and filter outlet 56, respectively. Unused space exists behind the filter release button 44 between the wall of the covering 38 and the filter housing 41 due to the positioning of the filter release button 44 on the filter housing 41. Thus, vessel 42 forms a pressure tank type reservoir that may be shaped and molded to fit within the space behind the filter release button 44 between the covering 38 and filter housing 41 such that no additional covering is needed. Furthermore, the vessel 42 is ergonomically defined to fit within this unused space within the covering 38. It is preferred that the vessel 42 snap into the covering 38. However, it should be appreciated that additional types of fasteners may be used to hold the vessel 42 within the covering 38. Such fasteners or restraints could include clamps, screws, straps, and/or additional fixturing.

Water line 52 is used to connect the vessel 42 to a water source 58. The vessel 42 receives water through vessel inlet 50 from a water source 58 using water line 52. The water within the vessel 42 exits through vessel outlet 48 using line 62 and travels in line 62 to the filter 40 entering the filter 40 through filter inlet 54. Water from the vessel 42 is filtered within the filter 40 and exits the filter 40 through filter outlet 56. The filter outlet 56 of the filter 40 is in fluid communication with valve 66 (not shown) using water line 60. The covering 38, vessel 42, filter 40 and water line 52 could be fully assembled and ready to install within refrigeration device 10. Additionally, the individual components such as the vessel 42, filter 40 and tubing 52 could arrive separately and be installed individually within the covering 38.

The vessel shown in FIG. 2 is just one embodiment of the vessel. The vessel 42 may be easily configured, shaped and molded to fit within any opening or unused space associated with the refrigeration device 10. For example, the vessel 42 may be positioned away from the filter 40 at an easily accessible position within the refrigeration device 10 and/or positioned within some unused, pre-existing space within the refrigeration device 10 so as to not occupy additional refrigerator space. Moreover, the vessel 42 may be of various sizes and configurations as is appreciated by those who are skilled in the art. As shown in FIG. 2, the vessel 42 is configured and/or molded to fit within the covering 38 so as to not interfere with the filter 40.

Figure 3:
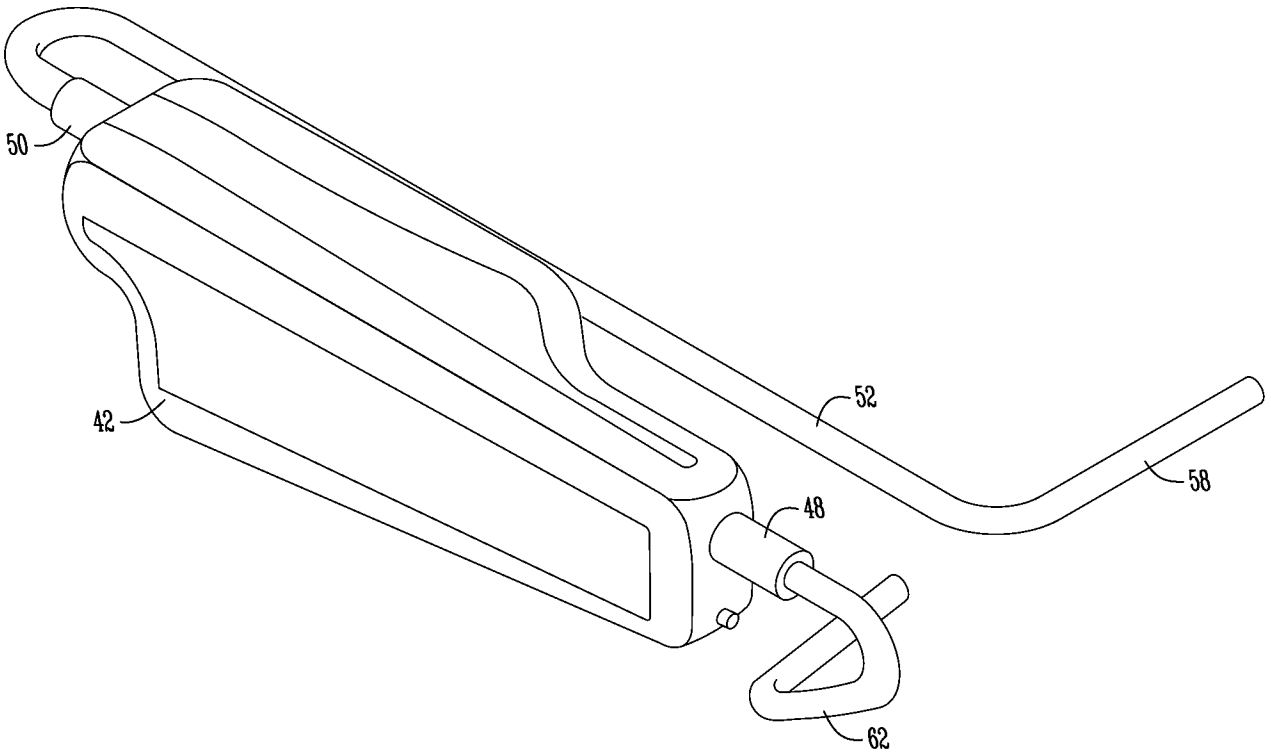
FIG. 3 is an isometric illustration of a water reservoir pressure vessel according to one exemplary embodiment of the present invention.
Figure 4:
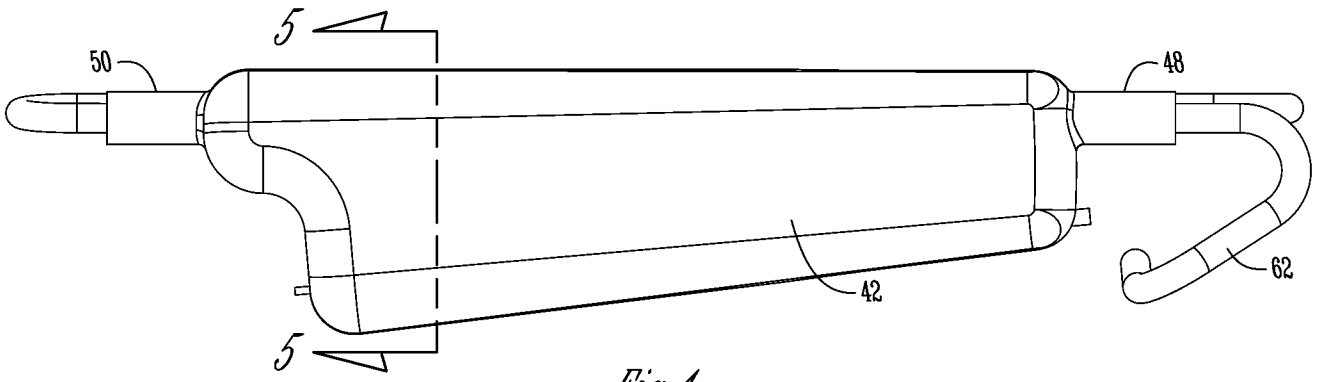
FIG. 4 is a side view of a water reservoir pressure vessel according to one exemplary embodiment of the present invention.

The vessel 42 shown in FIGS. 3 and 4 is just one embodiment as to size, shape, construction and preference. The vessel 42 has a hollow body with surrounding pressure-resistant walls. In the preferred embodiment the vessel 42 is constructed of a cross-linked, high-density polyethylene. One example of cross-linked high density polyethylene is PEX. The polyethylene material may be cross-linked via beta irradiation and/or by introduction of cross-link bonds into the polymer like material. Although cross-linked, high density polyethylene is preferred, it is appreciated and recognized that other materials may be used to construct the vessel 42. Such other materials might include a thermally resistant polymer or copolymer capable of withstanding pressure and remaining thermally stable under a pressure load and over the life of the refrigeration device 10. The use of cross-linked, high-density polyethylene allows the vessel 42 to be thermally stable under a pressure load and increases the vessel's 42 resistance against slow crack propagation and/or fatigue related failures. For example, the vessel 42 must be capable of withstanding thermal expansion and contraction of the vessel due to the material of the vessel 42 being exposed to different temperatures. Moreover, the vessel 42 must be able to withstand the pressure from the water source 58 over the life of the refrigerator 10. For example, when the vessel 42 is positioned between valve 66 (see, FIG. 6 for water source 58 and valve 66) and the water source 58, the vessel experiences internal hydrostatic pressure as a function of the water pressure of the water from the water source 58. The combination of internal hydrostatic pressure with the expansion and contraction of the walls of the vessel 42 can accentuate fatigue related failure modes within the vessel 42. Importantly, the vessel 42 is capable of operating hydrostatically under pressure; the vessel 42 can be positioned between the water source 58 and the valve 66. Thus, the vessel 42 operates at the pressure of the water source 58, whereas the traditional coil, baffle, and corrugated reservoirs operate under atmospheric pressure. To operate under pressure, vessel inlet 50 and outlet 48 are firmly bonded to the vessel 42 and fused to the line 52 and 62, respectively. One benefit of having a vessel 42 that operates at the internal hydrostatic pressure of the water source 58 is the reduction in the number lines and line lengths. For example, due to the shape-ability and mold-ability of the vessel 42 the vessel 42 may be positioned near or around the filter 40 thereby reducing the number of lines and the length of the lines for communicating water from the water source 58 through the vessel 42 and to the filter 40. Additionally, because the vessel 42 is capable of withstanding internal hydrostatic pressures as a result of the water source 58, the vessel 42 may be positioned and/or disposed inline in advance of the filter 40. Thus, any water residing in the vessel 42 is not filtered and contains chlorine and other purification agents to prevent and eliminate bacterial growth within the vessel 42. Similarly, the requisite taste and odor requirements of the water in the vessel 42 are maintained by keeping purification agents, such as chlorine, in the water in the vessel 42. Positioning the vessel 42 before the filter 40 allows the interior of the vessel 42 to remain sanitary over the life of the refrigeration device 10.

Figure 5:
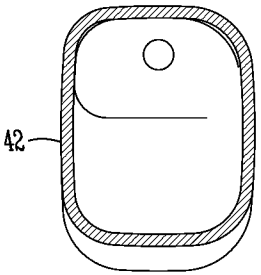
FIG. 5 is a cross-sectional view of FIG. 4 taken along line 5-5 of a water reservoir pressure vessel according to one exemplary embodiment of the present invention.

FIG. 5 is a cross-sectional view of FIG. 4 taken along line 5-5 of a water reservoir pressure vessel according to one exemplary embodiment of the present invention. FIG. 5 shows the outer periphery and pressure resistant walls of the vessel 42. The vessel 42 can be optimally sized to fit within a pre-existing space yet store a sufficient amount of chilled water based on the average dispersal to the water dispenser and/or ice maker. For example, the additional volume of the vessel 42 allows water to reside within the vessel 42 which is subsequently chilled to the temperature of the surrounding air within the refrigeration device 10. Use of the vessel 42 in combination with the filter 40 allows the user to have additional chilled water for use at the exterior dispenser and/or icemaker. The volume of the vessel 42 is configurable based on the space in which the vessel 42 is positioned. As the vessel 42 is mold-able and shape-able to fit the size of any unused shape, the vessel 42 is optimized in its volume for storing chilled water for subsequent use. It can be further appreciated that it would be beneficial to optimize the volume of the vessel 42 to fit within the space provided thereby increasing the proportion of chilled water within the vessel 42 for subsequent use. Additionally, it can be further appreciated that because of the mold-ability and shape-ability of the vessel 42 the vessel can occupy the entire shape of the whole pre-existing area as opposed to a coil or a baffle system that would be restricted to a certain shape or size and not fully able to best use the available space.

As also shown in FIG. 5, the vessel 42 has sidewalls capable of withstanding the thermal expansion and contraction resulting from the change in temperature in the refrigeration device 10. The periphery of the vessel is defined by a wall thickness that is designed to withstand the internal hydrostatic pressure from the water source 58 within the vessel 42 over the life of the refrigeration device 10.

Figure 6:
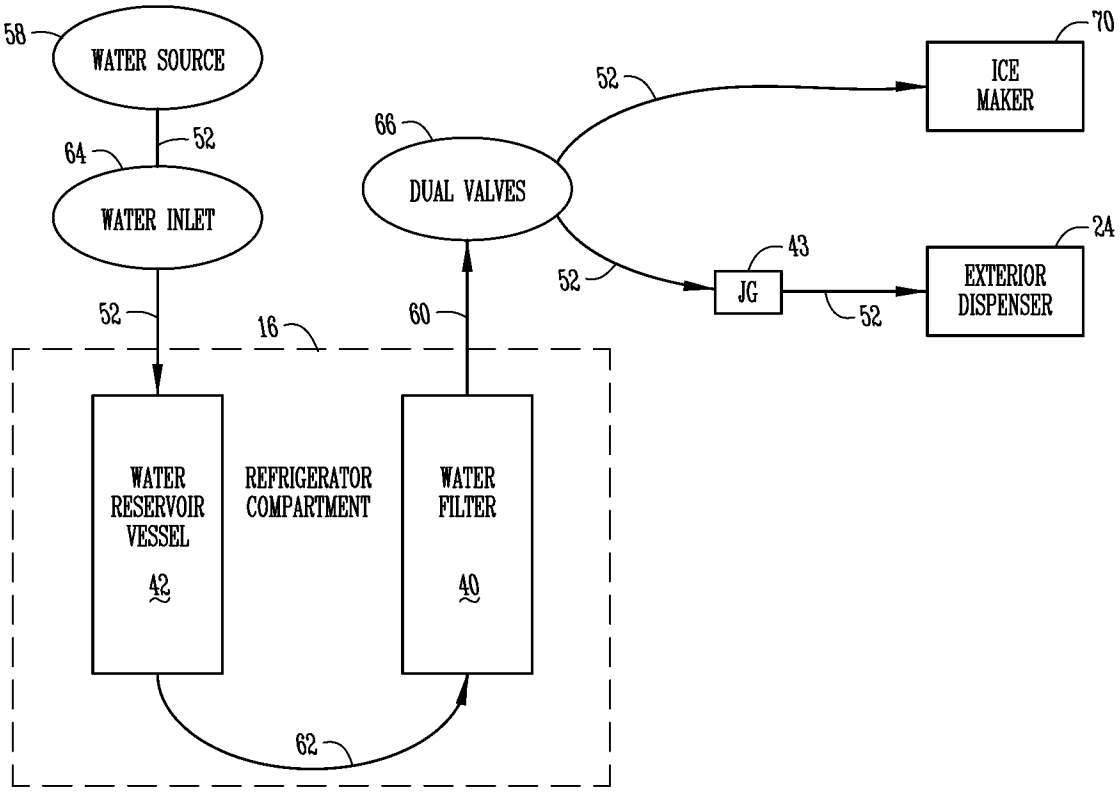
FIG. 6 is a schematic illustration of a water supply circuit for a refrigeration device having a water reservoir pressure vessel configured according to one exemplary embodiment of the present invention.

FIG. 6 is a schematic illustration of a water supply circuit for a refrigeration device having a water reservoir pressure vessel 42 configured according to one exemplary embodiment of the present invention. It can be appreciated that all water dispensing refrigerators acquire water from some water source 58. For example, as is customary, a household water line could be tapped into to supply water to the refrigeration device 10. Water line 52 from the water source 58 provides water at the inlet 64. The inlet 64 may be positioned anywhere on the refrigeration device 10 such that the water line 52 can pass through the refrigerator compartment 16 or freezer compartment 14 of the refrigeration device 10. Water line 52 to the vessel 42 is disposed in fluid communication with and after the water inlet 64. Furthermore, the hydrostatic pressure of the water within the vessel 42 is a function of the water pressure from the water source 58. Water line 62 to the filter 40 from the vessel 42 permits communication of water between the vessel 42 and the filter 40. The vessel 42 and filter 40 may be positioned together or apart within the refrigeration device 10. Preferably, the vessel 42 is placed prior to the filter 40 such that water from the water inlet 64 passes through the vessel 42 prior to being introduced at the filter 40. Valves 66 are positioned between the filter 40 and the exterior dispenser 24 and/or icemaker 70. Valves 66 can be a single valve or dual solenoid valves for dispensing water to the exterior dispenser 24 and/or ice maker 70. The vessel 42 may be placed inline before the valve 66 because the vessel 42 is capable of operating at the internal hydrostatic pressure resulting from the water inlet 64. As discussed previously, the vessel 42 experiences thermal expansion and contraction as the temperature of the water in the vessel and the air surrounding the vessel changes. Accordingly, if the vessel 42 is positioned after the valves 66 the water dispenser is likely to drip water at the exterior dispenser 24 due to the thermal expansion and contraction of the vessel 42. Dispenser drip is significantly reduced if not nearly eliminated by disposing the vessel 42 inline in advance of the valve 66. Moreover, by placing vessel 42 prior to the filter 40 allows chlorinated water to reside in the vessel 42. Keeping chlorinated water within the vessel 42 as opposed to filtered water prevents bacterial growth and provides an improved taste being dispensed at the exterior dispenser 24 and/or icemaker 70. The vessel 42 and filter 40 may be positioned close to the dispensing point, whether the exterior dispenser 24 and/or icemaker 70, because the vessel 42 is capable of operating under pressure. This provides a fresher, cleaner tasting water as the water is reservoired in the vessel 42 and filtered prior to being dispensed for use. Additionally, increasing the amount of pre-chilled water using the vessel 42 would allow greater volumes of chilled water to be provided to the ice maker 70 thereby increasing the ice production. By providing a vessel 42 that can operate at the internal hydrostatic pressure resulting from the water source 58 decreases the number of tubes or lines required to fluidly communicate water from the water source 58 to the water dispenser 24 and ice maker 70. Importantly, as best illustrated in FIG. 2, the number of water lines required to communicate water through the refrigerator compartment 16 to the vessel 42 and from the filter 40 is reduced to two (2) lines. It can be appreciated by those skilled in the art that fewer points of ingress and egress through the refrigerator compartment 16 would be beneficial to the manufacturing process, the efficiency of the refrigerator and the cost of installation. For example, by eliminating the number of lines required to fluidly communicate water to the vessel 42 and the filter 40 and subsequently the water dispenser 24 and ice dispenser 70 decreases the overall cost of incorporating the vessel 42 into the refrigeration device 10.

The preferred embodiment of this present invention has been set forth in the drawings and specification and those specific terms are employed, these are used in the generically descriptive sense only and are not used for the purposes of limitation. Changes in the formed proportion of parts as well in the substitution of equivalence are contemplated as circumstances may suggest are rendered expedient without departing from the spirit and scope of the invention as further defined in the following claims.

What is claimed is:

1. A water vessel for use with a refrigeration device having a cabinet with a filter enclosed in a filter housing having an internal volume with some unoccupied space and a water dispensing system to dispense water from a water supply line to an exterior water dispenser and/or an icemaker, the water vessel comprising:

an inlet adapted to be in continual open fluid communication with the water supply line and an outlet adapted to be in continual open fluid communication with the exterior water dispenser;

the water vessel enclosed within the filter housing within the cabinet, whereby the water supply line passes through a wall of the filter housing and is attached within the housing at the inlet of water vessel;

opposing elongated side and top and bottom pressure resistant walls spaced between opposing end walls, wherein the inlet and the outlet pass through the respective end walls adapted to form an internal volume to reservoir water within the filter housing; and one end wall of the water vessel having a concave-shaped profile adapted to fit within the volume of unoccupied space within the filter housing behind a filter release on the housing;

the water vessel constructed to reservoir water under continuous hydrostatic pressure from the water supply line for providing a charge of water through a line passing through the wall of the filter housing when requested by the exterior water dispenser and/or the icemaker.

2. The water vessel of claim 1 being constructed of a cross-linked, high-density polyethylene to thereby withstand thermal expansion and contraction and hydrostatic pressure from the water supply line.

3. The water vessel of claim 2 wherein the water vessel is cross-linked by beta irradiation.

4. The water vessel of claim 1 wherein the filter housing enclosing the water filter and the water vessel is in fluid communication with and disposed inline in advance of at least one water valve of the water dispensing system.

5. The water vessel of claim 4 wherein water from the water supply line is communicated through the filter housing and the inlet of the water vessel and reservoired in the water vessel under continuous pressure from the water supply line, and communicated through the wall of the filter housing from an outlet of the water filter upon actuation of the water valve.

6. The water vessel of claim 1 wherein a water line within the filter housing connects the outlet of the water vessel in fluid communication with and inline in advance of an inlet of the water filter of the water dispensing system.

7. The water vessel of claim 1 in combination with a refrigerator comprising a cabinet having a refrigerated and freezer compartment, wherein the filter housing is disposed within the cabinet.

8. A method for dispensing water from a refrigeration device comprising:

providing a refrigerated cabinet having a water dispensing system comprising a water filter and a water vessel enclosed in a filter housing behind a filter release actuator on the housing and disposed inline in advance of at least one water valve for dispensing water to an exterior water dispenser from a water supply line;

communicating water through the filter housing into an inlet of the water vessel having opposing elongated side and top and bottom pressure resistant walls spaced between opposing end walls housing the inlet and an outlet respectively, the walls adapted to form an internal volume;

reservoiring water in the water vessel within the filter housing in the refrigerated cabinet in continual open communication with the water supply line;

storing water within the water vessel under continual hydrostatic pressure from the water supply line;

communicating water out of the filter housing from the water vessel when requested at the exterior water dispenser; and dispensing water from the water vessel at the exterior water dispenser.

9. The method of claim 8 further comprising keeping the water vessel and the water filter in the filter housing in continual open communication with the water supply line and each other for filtering water from the water vessel before dispensing at the exterior water dispenser.

10. The method of claim 8 wherein the vessel is disposed inline in advance of the water valve for preventing water from dripping from the exterior water dispenser during thermal expansion and contraction of the water vessel.

11. The method of claim 8 in combination with a refrigerator comprising a cabinet having a refrigerated compartment and freezer compartment, wherein the filter housing is disposed within the cabinet.

12. A refrigerator, comprising:

(a) a cabinet having a refrigerated and freezer compartment; and (b) a water dispensing system partially disposed within the cabinet for providing water to drink and/or to an icemaker for making ice, the water dispensing system including:

(i) an exterior water dispenser for providing water and/or ice from within one of the compartments;

(ii) a water supply line in fluid communication with at least one water valve and the exterior water dispenser, the water supply line under pressure from its source;

(iii) a water filter enclosed in a filter housing and a filter release actuator on the filter housing, the water filter disposed inline between the water supply line and the water valve;

(iv) a water vessel having elongated side walls spaced between opposing end walls, wherein an inlet and an outlet pass through respective opposing end walls, the water vessel enclosed in the filter housing adjacent the filter in fluid communication with and disposed inline in advance of the water filter, in continual open communication with the water supply line and under continual pressure from the water supply line;

(v) one end wall of the water vessel having a concave profile, the concave profile disposed in the filter housing behind the filter release actuator to accommodate a portion of the filter release actuator, the filter release actuator extends into the filter housing spaced between the water filter and a side wall of the filter housing; and (vi) the water vessel having a volume to reservoir water under continual pressure from the water supply line for providing a charge of water when requested by the exterior water dispenser and/or the icemaker.

13. The refrigerator of claim 12 wherein the water vessel comprises an inlet and outlet in continual open communication with the water supply line, the vessel being disposed inline in advance of the water valve to thereby prevent water drip from the exterior water dispenser.

14. The refrigerator of claim 13 further comprises a plurality of water lines:

a. a first line passing through the filter housing, the first line in continual open communication with the water supply line and the inlet of the water vessel for communicating water through the filter housing to the water vessel;

b. a second line in continual open communication with the outlet of the water vessel and an inlet of the water filter; and c. a third line passing through the filter housing, the third line in continual open communication with an outlet of the water filter and the exterior water dispenser and/or the icemaker for communicating water through the filter housing to the water dispenser and/or icemaker.

15. The refrigerator of claim 12 wherein the water vessel profile includes at least one end wall having a concave-shaped profile to accommodate fix space occupied in the filter housing by the filter release actuator.

16. A refrigeration device, comprising:

(a) a cabinet (b) a refrigeration housing within the cabinet; and (c) a water dispensing system partially disposed within the refrigeration housing for providing water to an exterior water dispenser to drink and/or to an icemaker for making ice, the water dispensing system including:

(i) a water supply line in continuous open fluid communication with a water vessel, a water filter and at least one water valve;

(ii) a filter enclosure having a bottom wall spaced between opposing side walls for housing the water filter;

(iii) an otherwise unoccupied space within the filter enclosure surrounded generally by one side wall and bottom wall of the enclosure, the water filter and a filter release actuator located on the filter enclosure;

(iv) the water vessel having a body with opposing elongated side walls and top and bottom walls spaced between opposing end walls, wherein an inlet and an outlet pass through respective opposing end walls of the body;

(v) the water vessel enclosed within the filter enclosure and positioned within the unoccupied space with the opposing side walls of the vessel adjacent the water filter and the filter enclosure side wall behind the filter release actuator; and (vi) the water vessel having an outlet in fluid communication and disposed inline in advance of the water valve to reservoir water inline in the body under hydrostatic pressure in advance of the water filter and the water valve until requested by the exterior water dispenser and/or the icemaker.

17. The refrigeration device of claim 16 comprises a refrigerator having a refrigerated compartment and a freezer compartment, the filter enclosure positioned within the refrigerated compartment of the refrigerator.

18. The refrigeration device of claim 17 wherein the water vessel is enclosed within the unoccupied space within the filter enclosure to thereby eliminate occupation of additional space within the cabinet.

19. The refrigeration device of claim 18 wherein the filter enclosure housing the water filter and the water vessel are a completed assembly for installation within the cabinet.

20. The refrigeration device of claim 18 wherein:

a. the water supply line passes through a wall of the filter enclosure and is attached at the inlet of the water vessel within the filter enclosure for communicating water to the water vessel; and b. a line passing through the wall of the filter enclosure attached at an outlet of the water filter for communicating water to the exterior water dispenser and/or the icemaker.

21. The refrigeration device of claim 16 wherein the water vessel is constructed of a cross-linked, high-density polyethylene to resist fatigue related failures.

22. The refrigeration device of claim 21 wherein the water vessel is cross-linked by beta irradiation to withstand thermal expansion and contraction and hydrostatic pressure from the water supply line.

23. The refrigeration device of claim 16 wherein water within the water vessel is unfiltered to prevent bacteria growth within the water vessel.

* * * * *